US010378227B2

(12) United States Patent
Burnsed

(10) Patent No.: US 10,378,227 B2
(45) Date of Patent: Aug. 13, 2019

(54) POOL CLEANING ASSEMBLY

(71) Applicant: Daniel Burnsed, Savannah, GA (US)

(72) Inventor: Daniel Burnsed, Savannah, GA (US)

( * ) Notice: Subject to any disclaimer, the term of this patent is extended or adjusted under 35 U.S.C. 154(b) by 0 days.

(21) Appl. No.: 15/800,754

(22) Filed: Nov. 1, 2017

(65) Prior Publication Data

US 2019/0128005 A1 May 2, 2019

(51) Int. Cl.
*E04H 4/16* (2006.01)
*B08B 3/04* (2006.01)

(52) U.S. Cl.
CPC ..... *E04H 4/1609* (2013.01); *B08B 3/04* (2013.01)

(58) Field of Classification Search
CPC ..... E04H 4/1609; B08B 3/04
USPC ... 210/167.12, 167.14, 167.16, 416.1, 416.2; 15/1.7; 134/166 R
See application file for complete search history.

(56) References Cited

U.S. PATENT DOCUMENTS 2,980,256 A 4/1961 Nash
3,864,262 A 2/1975 Lang et al.
5,557,819 A * 9/1996 Krolikowski ..... E04H 4/1636 134/167 R
5,989,419 A 11/1999 Dudley
6,119,293 A * 9/2000 Phillipson ..... E04H 4/1663 15/1.7
6,463,943 B1 10/2002 Monroe
6,709,581 B2 3/2004 Leckal
7,311,823 B2 12/2007 Brooke
D753,318 S 4/2016 Kweller et al.
2004/0047675 A1 3/2004 Bonelli et al.
2005/0198751 A1* 9/2005 Navratil ..... E04H 4/1636 15/1.7
2010/0064455 A1* 3/2010 Rissik ..... E04H 4/1663 15/1.7
2010/0139017 A1* 6/2010 Stoltz ..... E04H 4/1663 15/1.7
2011/0232699 A1* 9/2011 Schreiber ..... B01D 41/00 134/198

* cited by examiner

*Primary Examiner* — Fred Prince

(57) ABSTRACT

A pool cleaning assembly for cleaning an above ground pool includes a hose that may be fluidly coupled to an intake of a filtration unit of a pool thereby facilitating the filtration unit of the pool to generate suction in the hose. A first tube is selectively and fluidly coupled to the hose to generate suction in the first tube when the hose is fluidly coupled to the intake. A plurality of second tubes is provided and each of the second tubes is selectively and fluidly coupled to the hose to extend a length of the hose. A plurality of cleaning attachments is provided and each of the cleaning attachments is selectively and fluidly coupled to the hose. Each the cleaning attachments is manipulated for cleaning an inside surface of a pool. A holding unit is provided and a pool filter is positioned thereon for cleaning the pool filter.

10 Claims, 5 Drawing Sheets

POOL CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

1. Field of the Invention
2. Description of Related Art Including Information Disclosed Under 37 CFR 1.97 and 1.98

The disclosure and prior art relates to cleaning devices and more particularly pertains to a new cleaning device for cleaning an above ground pool.

BRIEF SUMMARY OF THE INVENTION

An embodiment of the disclosure meets the needs presented above by generally comprising a hose that may be fluidly coupled to an intake of a filtration unit of a pool thereby facilitating the filtration unit of the pool to generate suction in the hose. A first tube is selectively and fluidly coupled to the hose to generate suction in the first tube when the hose is fluidly coupled to the intake. A plurality of second tubes is provided and each of the second tubes is selectively and fluidly coupled to the hose to extend a length of the hose. A plurality of cleaning attachments is provided and each of the cleaning attachments is selectively and fluidly coupled to the hose. Each the cleaning attachments is manipulated for cleaning an inside surface of a pool. A holding unit is provided and a pool filter is positioned thereon for cleaning the pool filter.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
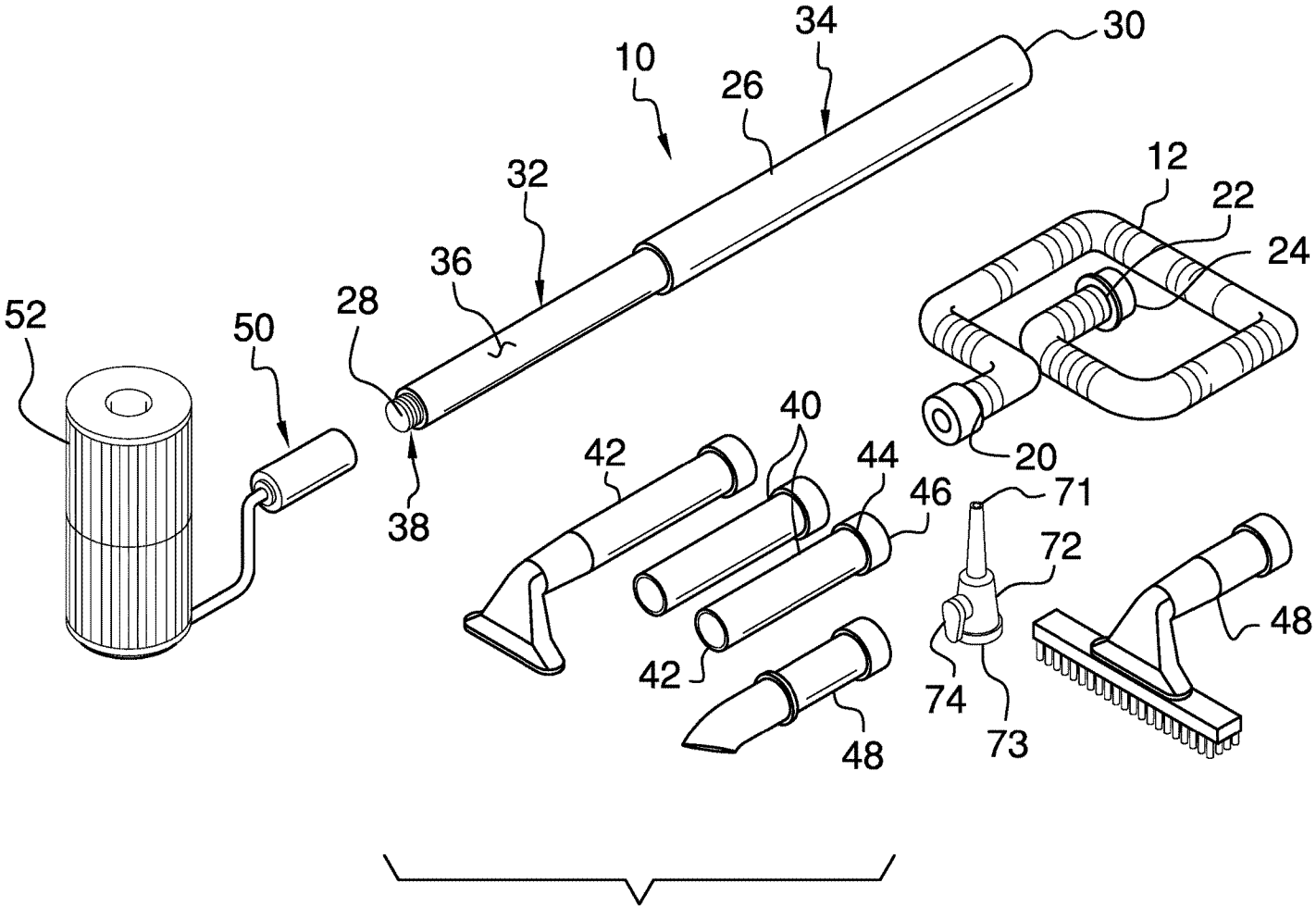
FIG. 1 is a perspective kit view of a pool cleaning assembly according to an embodiment of the disclosure.
Figure 2:
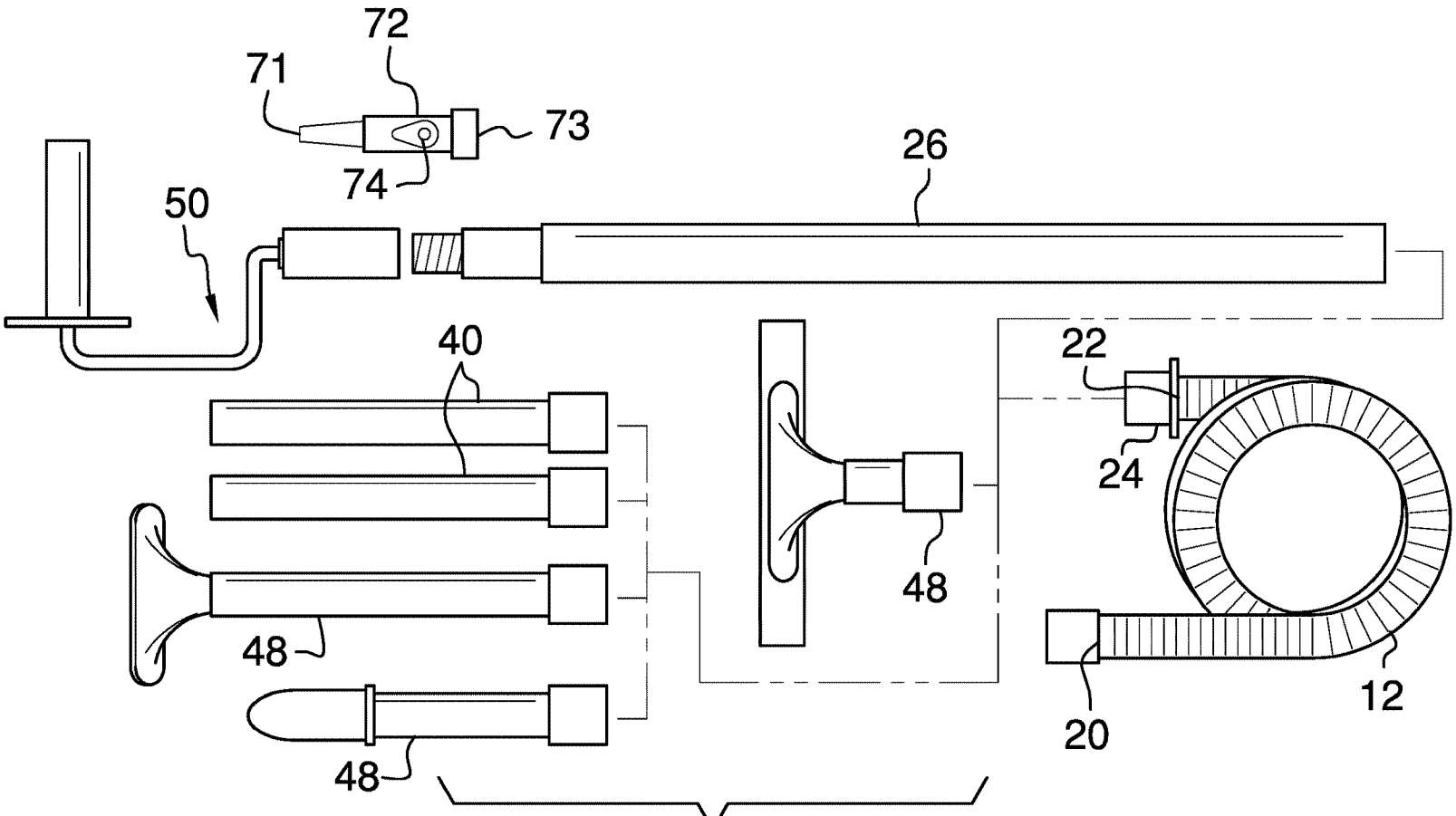
FIG. 2 is a top kit view of an embodiment of the disclosure.
Figure 3:
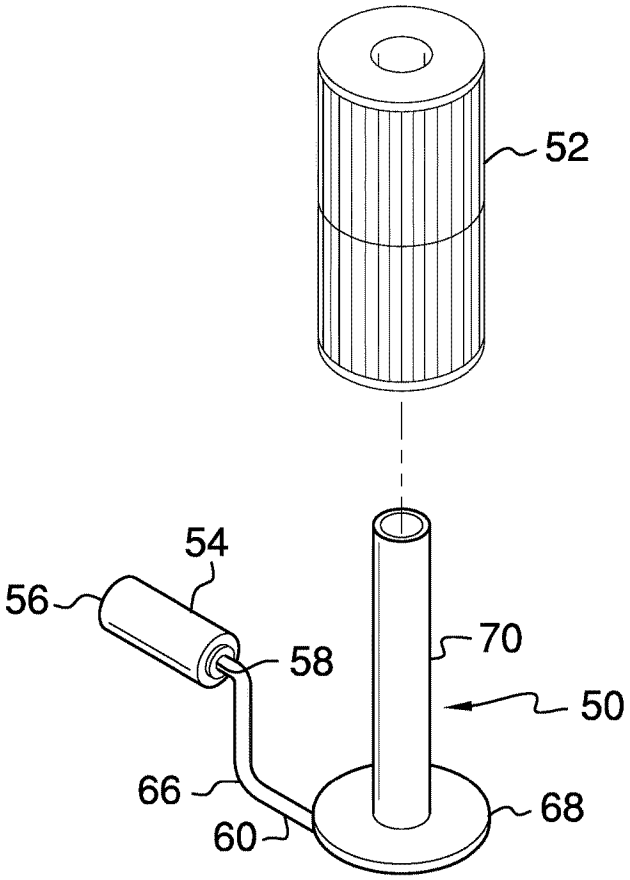
FIG. 3 is an exploded view of a holding unit of an embodiment of the disclosure.
Figure 4:
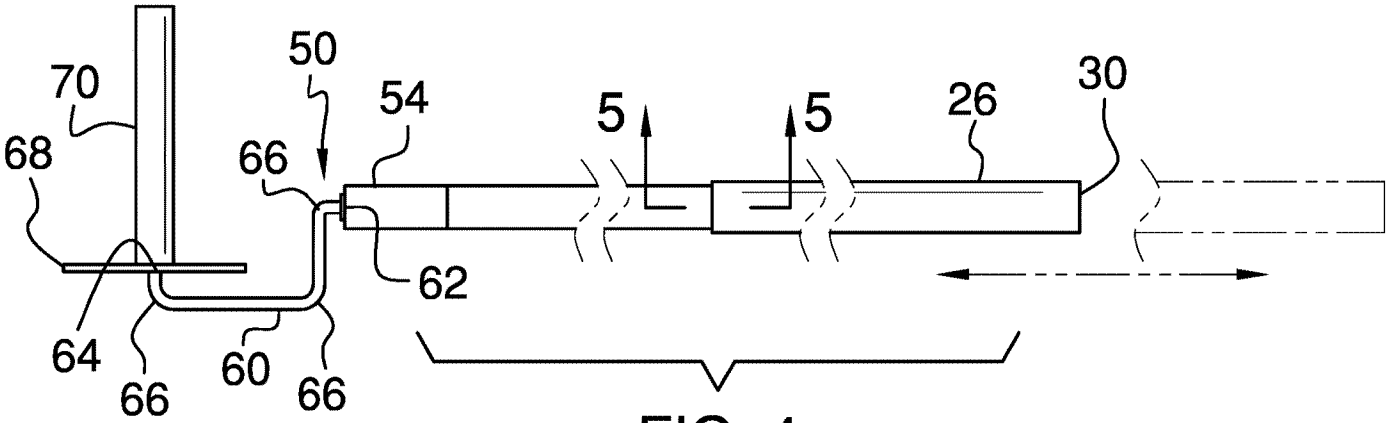
FIG. 4 is a perspective view of first tube of an embodiment of the disclosure.
Figure 5:
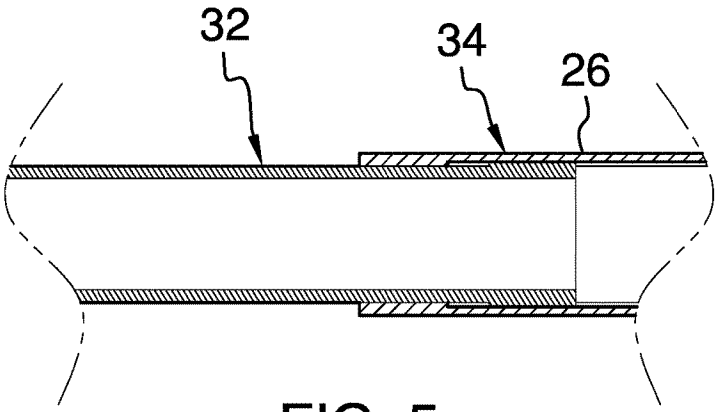
FIG. 5 is a cross sectional view taken along line 5-*f* of FIG. 4 an embodiment of the disclosure.
Figure 6:
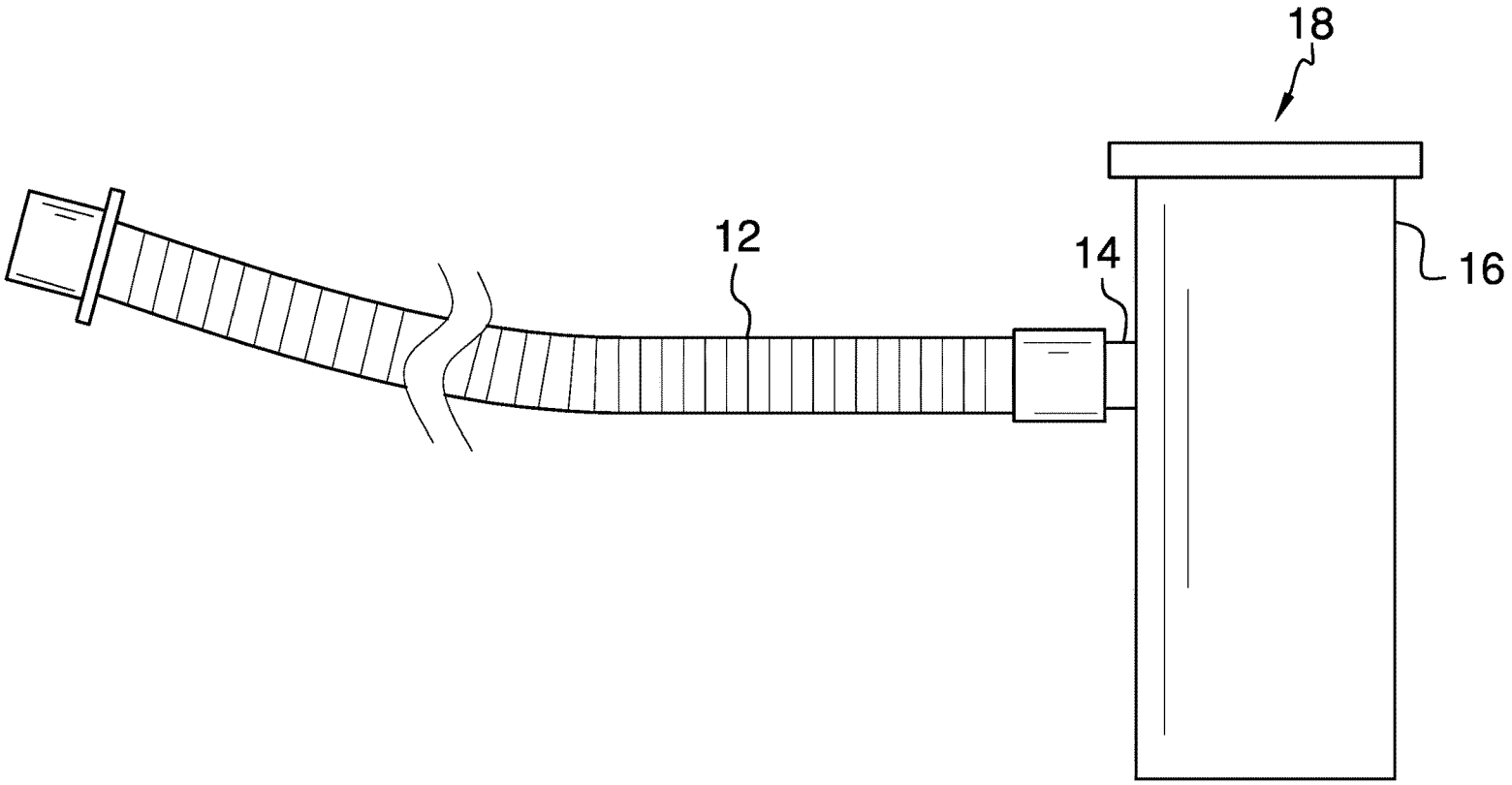
FIG. 6 is a perspective in-use view of an embodiment of the disclosure.

With reference now to the drawings, and in particular to FIGS. 1 through 6 thereof, a new cleaning device embodying the principles and concepts of an embodiment of the disclosure and generally designated by the reference numeral 10 will be described.

As best illustrated in FIGS. 1 through 6, the pool cleaning assembly 10 generally comprises a hose 12 that may be fluidly coupled to an intake 14 of a filtration unit 16 of a pool 18. In this way the filtration unit 16 of the pool generates suction in the hose 12. The pool 18 may be an above ground swimming pool or the like and the filtration unit 16 may be an electric pool filtration unit common to above ground pools. The hose 12 has a first end 20 and a second end 22 and the first end 20 is fluidly coupled to the intake 14. A coupler 24 is coupled to the second end 22 of the hose 12 and the hose 12 may be flexible pool 18 hose 12 of any conventional design.

A first tube 26 is provided and the first tube 26 is selectively and fluidly coupled to the hose 12. In this way the hose 12 communicates the suction to the first tube 26 when the hose 12 is fluidly coupled to the intake 14. The first tube 26 has a primary end 28 and a secondary end 30. Additionally, the first tube 26 has a first section 32 that is slidably coupled to a second section 34 such that the first tube 26 has a telescopically adjustable length. The first section 32 has an outside surface 36 and the outside surface 36 has a threaded portion 38 that is positioned adjacent to the primary end 28. The secondary end 30 selectively and insertably receives the coupler 24 on the hose 12 such that the first tube 26 is in fluid communication with the hose 12.

A plurality of second tubes 40 is provided and each of the second tubes 40 is selectively and fluidly coupled to the hose 12 to extend a length of the hose 12. Each of the second tubes 40 has a primary end 42 and a secondary end 44. The secondary end 44 corresponding to each of the second tubes 40 has a receiver 46 coupled thereto. Moreover, the receiver 46 corresponding to each of the second tubes 40 selectively and insertably receives the coupler 24 on the hose 12. Thus, the corresponding second tube 40 is in fluid communication with the hose 12.

A plurality of cleaning attachments 48 is provided and each of the cleaning attachments 48 is selectively and fluidly coupled to the hose 12. Each of the cleaning attachments 48 is substantially hollow and each the cleaning attachments 48 is manipulated for cleaning an inside surface of a pool 18. The plurality of cleaning attachments 48 may include a pool cleaning brush, a suction nozzle that has a broadened end and a suction nozzle that has a narrow end.

A holding unit 50 is provided and a pool filter 52 is selectively positioned thereon for cleaning the pool filter 52 and the holding unit 50 is selectively coupled to the first tube 26. The holding unit 50 comprises a third tube 54 that has a first end 56 and a second end 58. The first end 56 threadably engages the threaded portion 38 of the first tube 26. The holding unit 50 includes a rod 60 that has a first end 62 and a second end 64. The rod 60 has a sequence of bends 66 thereon such that the rod 60 has an S-shape. Moreover, the first end 62 of the rod 60 is coupled to the second end of the third tube 54.

A disk 68 is coupled to the second end of the rod 60 and a column 70 is coupled to and extends upwardly from the disk 68. The column 70 may have the pool filter 52 positioned therearound having the pool filter 52 resting on the disk 68. The pool filter 52 may be a cylindrical pool filter of any conventional design. A spray nozzle 72 is provided in the spray nozzle 72 has a primary end 71 and a secondary end 73. Each of the primary end 71 and the secondary end 73 of the spray nozzle 72 are open and the primary end 71 of the spray nozzle 72 has a diameter that is less then a diameter of the secondary end 73 of the spray nozzle 72.

The secondary end 30 is selectively coupled to a fluid source such as a water hose 12 or the like. A valve 74 is coupled to the spray nozzle 72 and the valve 74 is selectively manipulated between on position and an off position. The valve 74 inhibits fluid from passing through the spray nozzle 72 when the valve 74 is in the off position. Additionally, the valve 74 allows fluid to pass through the spray nozzle 72 when the valve 74 is in the on position.

In use, the first end of the hose 12 is selectively coupled to the intake 14 of the filtration unit 16. Selected ones of the second tubes 40, the first tube 26, and the cleaning attachments 48 are selectively coupled to the coupler 24 on the hose 12 for cleaning the pool 18. The filtration unit 16 in the pool 18 facilitates suction to be generated without requiring additional equipment to be purchased for cleaning the pool 18. The holding unit 50 is selectively coupled to the first tube 26 for cleaning the pool filter 52. The pool filter 52 is positioned on the column 70 and the spray nozzle 72 is fluidly coupled to the fluid source. The spray nozzle 72 is manipulated to spray fluid on the pool filter 52 for cleaning the pool filter 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pool cleaning assembly being configured to be fluidly coupled to an intake of a filtration unit of a pool for cleaning a pool filter and a pool, said assembly comprising:

a hose being configured to be fluidly coupled to an intake of a filtration unit of a pool thereby facilitating the filtration unit of the pool to generate suction in said hose;

a first tube being selectively and fluidly coupled to said hose wherein said hose is configured to generate suction in said first tube when said hose is fluidly coupled to the intake;

a plurality of second tubes, each of said second tubes being selectively and fluidly coupled to said hose to extend a length of said hose;

a plurality of cleaning attachments, each of said cleaning attachments being selectively and fluidly coupled to said hose, each said cleaning attachments being configured to be manipulated for cleaning an inside surface of a pool; and a holding unit being configured to have a pool filter positioned thereon for cleaning the pool filter, said holding unit being selectively coupled to said first tube.

2. The assembly according to claim 1, wherein said hose has a first end and a second end, said first end being configured to be fluidly coupled to the intake, said second end having a coupler being coupled thereto.

3. The assembly according to claim 2, wherein said first tube has a primary end and a secondary end, said first tube having a first section being slidably coupled to a second section such that said first tube has a telescopically adjustable length.

4. The assembly according to claim 3, wherein said first section has an outside surface, said outside surface having a threaded portion being positioned adjacent to said primary end.

5. The assembly according to claim 4, wherein said secondary end selectively and insertably receives said coupler on said hose such that said first tube is in fluid communication with said hose.

6. The assembly according to claim 4, wherein said holding unit comprises a third tube having a first end and a second end, said first end threadably engaging said threaded portion of said first tube.

7. The assembly according to claim 6, further comprising a rod having a first end and a second end, said rod having a sequence of bends thereon such that said rod has an S-shape, said first end of said rod being coupled to said second end of said tube.

8. The assembly according to claim 7, further comprising a disk being coupled to said second end of said rod.

9. The assembly according to claim 8, further comprising a column being coupled to and extending upwardly from said disc wherein said column is configured to have the pool filter positioned therearound having the pool filter resting on said disc.

10. A pool cleaning assembly being configured to be fluidly coupled to an intake of a filtration unit of a pool for cleaning a pool filter and a pool, said assembly comprising:

a hose being configured to be fluidly coupled to an intake of a filtration unit of a pool thereby facilitating the filtration unit of the pool to generate suction in said hose, said hose has a first end and a second end, said first end being configured to be fluidly coupled to the intake, said second end having a coupler being coupled thereto;

a first tube being selectively and fluidly coupled to said hose wherein said hose is configured to generate suction in said first tube when said hose is fluidly coupled to the intake, said first tube having a primary end and a secondary end, said first tube having a first section being slidably coupled to a second section such that said first tube has a telescopically adjustable length, said first section having an outside surface, said outside surface having a threaded portion being positioned adjacent to said primary end, said secondary end selectively and insertably receiving said coupler on said hose such that said first tube is in fluid communication with said hose;

a plurality of second tubes, each of said second tubes being selectively and fluidly coupled to said hose to extend a length of said hose, each of said second tubes having a primary end and a secondary end, said secondary and corresponding to each of said second tubes having a receiver being coupled thereto, said receiver corresponding to each of said second tubes selectively and insertably receiving said coupler on said hose such that said corresponding second tube is in fluid communication with said hose;

a plurality of cleaning attachments, each of said cleaning attachments being selectively and fluidly coupled to said hose, each of said cleaning attachments being substantially hollow, each said cleaning attachments being configured to be manipulated for cleaning an inside surface of a pool;

a holding unit being configured to have a pool filter positioned thereon for cleaning the pool filter, said holding unit being selectively coupled to said first tube, said holding unit comprising:

a third tube having a first end and a second end, said first end threadably engaging said threaded portion of said first tube, a rod having a first end and a second end, said rod having a sequence of bends thereon such that said rod has an S-shape, said first end of said rod being coupled to said second end of said tube, a disk being coupled to said second end of said rod, and a column being coupled to and extending upwardly from said disc wherein said column is configured to have the pool filter positioned therearound having the pool filter resting on said disc.

* * * * *